US012460388B2

(12) United States Patent
Oi et al.

(10) Patent No.: US 12,460,388 B2
(45) Date of Patent: Nov. 4, 2025

(54) CONTROL DEVICE AND CONTROL METHOD FOR WORK MACHINE

(71) Applicant: KOMATSU LTD., Tokyo (JP)

(72) Inventors: Takeshi Oi, Tokyo (JP); Tomoki Konda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 931 days.

(21) Appl. No.: 17/251,458

(22) PCT Filed: Jul. 19, 2019

(86) PCT No.: PCT/JP2019/028412
§ 371 (c)(1),
(2) Date: Dec. 11, 2020

(87) PCT Pub. No.: WO2020/044845
PCT Pub. Date: Mar. 5, 2020

(65) Prior Publication Data

US 2021/0254312 A1 Aug. 19, 2021

(30) Foreign Application Priority Data

Aug. 31, 2018 (JP) ..... 2018-163643

(51) Int. Cl.
*E02F 9/26* (2006.01)
*E02F 3/43* (2006.01)
*E02F 9/20* (2006.01)

(52) U.S. Cl.
CPC ..... *E02F 9/261* (2013.01); *E02F 3/43* (2013.01); *E02F 9/2033* (2013.01)

(58) Field of Classification Search
None
See application file for complete search history.

(56) References Cited

U.S. PATENT DOCUMENTS 6,108,949 A 8/2000 Singh et al.
6,167,336 A 12/2000 Singh et al.
(Continued)

FOREIGN PATENT DOCUMENTS

CN 108431336 A 8/2018
JP 11-158934 A 6/1999
(Continued)

OTHER PUBLICATIONS

Translation of JP-2008303574-A (Year: 2008).*
(Continued)

*Primary Examiner* — Angela Y Ortiz
*Assistant Examiner* — Charles Pall
(74) *Attorney, Agent, or Firm* — GLOBAL IP COUNSELORS, LLP

(57) ABSTRACT

A control device for a work machine includes a three-dimensional map acquisition unit, a boundary specification unit, and an excavation start point determination unit. The work machine includes a travel body, a swing body supported by the travel body, and work equipment provided to the swing body and having a bucket. The three-dimensional map acquisition unit acquires a three-dimensional map indicating a shape around the work machine. The boundary specification unit specifies a traveling road boundary line in terrain shown by the three-dimensional map. The traveling road boundary line is a boundary line between a traveling road surface on which a transport vehicle is capable of traveling, and an excavation target by the work equipment. The excavation start point determination unit determines a point on the traveling road boundary line or a point above the traveling road boundary line as an excavation start point by the work equipment.

9 Claims, 12 Drawing Sheets

(56) References Cited

U.S. PATENT DOCUMENTS

| | | | | |
|---|---|---|---|---|
| 6,247,538 | B1 | 6/2001 | Takeda et al. | |
| 2013/0158785 | A1* | 6/2013 | Fukano | E02F 9/261 701/34.4 |
| 2016/0094806 | A1 | 3/2016 | Tasejima et al. | |
| 2016/0193920 | A1 | 7/2016 | Tsubone et al. | |
| 2018/0347154 | A1 | 12/2018 | Martinsson et al. | |
| 2019/0003152 | A1 | 1/2019 | Nakamura et al. | |
| 2020/0165799 | A1* | 5/2020 | Wu | E02F 9/262 |

FOREIGN PATENT DOCUMENTS

| | | | | | |
|---|---|---|---|---|---|
| JP | 11-247230 | A | | 9/1999 | |
| JP | 2002-515559 | A | | 5/2002 | |
| JP | 2008-106440 | A | | 5/2008 | |
| JP | 2008303574 | A | * | 12/2008 | |
| JP | 5202667 | B2 | | 6/2013 | |
| JP | 2016-65422 | A | | 4/2016 | |
| JP | 2017-14726 | A | | 1/2017 | |
| JP | 2017014726 | A | * | 1/2017 | E02F 9/20 |

OTHER PUBLICATIONS

The International Search Report for the corresponding international application No. PCT/JP2019/028412, issued on Sep. 3, 2019.

* cited by examiner

CONTROL DEVICE AND CONTROL METHOD FOR WORK MACHINE

CROSS-REFERENCE TO RELATED APPLICATIONS

This application is a U.S. National stage application of International Application No. PCT/JP2019/028412, filed on Jul. 19, 2019. This U.S. National stage application claims priority under 35 U.S.C. § 119 (a) to Japanese Patent Application No. 2018-163643, filed in Japan on Aug. 31, 2018, the entire contents of which are hereby incorporated herein by reference.

BACKGROUND

Field of the Invention

The present invention relates to a control device and a control method for a work machine.

Background Information

Japanese Unexamined Patent Application, First Publication No. H11-247230 discloses a method for planning earthwork. According to the method described in Japanese Unexamined Patent Application, First Publication No. H11-247230, an excavation site is divided into small areas in a lattice shape, and an excavation order of each area is determined. Japanese Unexamined Patent Application, First Publication No. H11-247230 describes an effect in which by setting the excavation order with an upper part of the excavation site being given priority, the force required for the work equipment is reduced when excavating a lower section, and it is possible to prevent lower earth from being blocked by upper earth.

SUMMARY

At an excavation site, a traveling surface on which a transport vehicle for transporting earth is capable of traveling is provided. For efficiency of excavation and loading, the traveling surface is provided adjacent to an excavation target. At this time, as described in Japanese Unexamined Patent Application, First Publication No. H11-247230, when earth is excavated from above the excavation site, when the excavation target collapses or earth spills from the bucket, the earth may flow on an inclined surface, and the earth may be scattered on the traveling surface. When the earth is scattered on the traveling surface, it hinders the travel of the transport vehicle.

An object of the present invention is to provide a control device and a control method for planning excavation so as to prevent earth from being scattered on a traveling surface.

An aspect of the present invention provides a control device for a work machine including a travel body, a swing body supported by the travel body and being capable of swinging about a swing center, and work equipment provided to the swing body and having a bucket, the control device comprising: a three-dimensional map acquisition unit that is configured to acquire a three-dimensional map indicating a shape around the work machine: a boundary specification unit that is configured to specify a traveling road boundary line in terrain shown by the three-dimensional map, the traveling road boundary line being a boundary line between a traveling road surface that is a surface on which a transport vehicle is capable of traveling and an excavation target by the work equipment; and an excavation start point determination unit that is configured to determine a point on the traveling road boundary line or a point above the traveling road boundary line as an excavation start point by the work equipment.

According to at least one of the aspects, the control device may plan excavation so as to prevent earth from being scattered on the traveling surface.

DETAILED DESCRIPTION OF EMBODIMENT(S)

First Embodiment

Hereinafter, embodiments will be described in detail with reference to the accompanying drawings.

Figure 1:
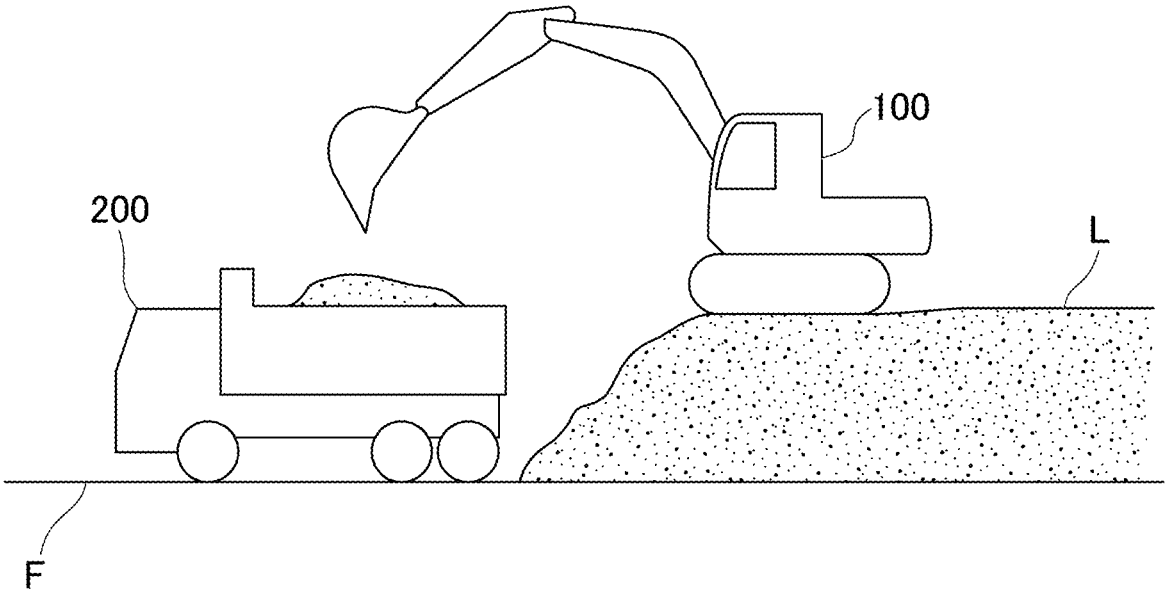
FIG. 1 is a diagram showing an example of excavation and loading work according to a first embodiment.

FIG. 1 is a diagram showing an example of excavation and loading work according to a first embodiment.

The first embodiment describes the excavation and loading work by a backhoe shovel. The loading machine 100, which is a backhoe shovel, is disposed in on an upper stage of a heap of the excavation target L, and loads excavated earth to a transport vehicle 200 located on a traveling road surface F that is a lower stage of the excavation target L. The traveling road surface F is flattened so that the transport vehicle 200 is capable of traveling.

(Configuration of Loading Machine)

Figure 2:
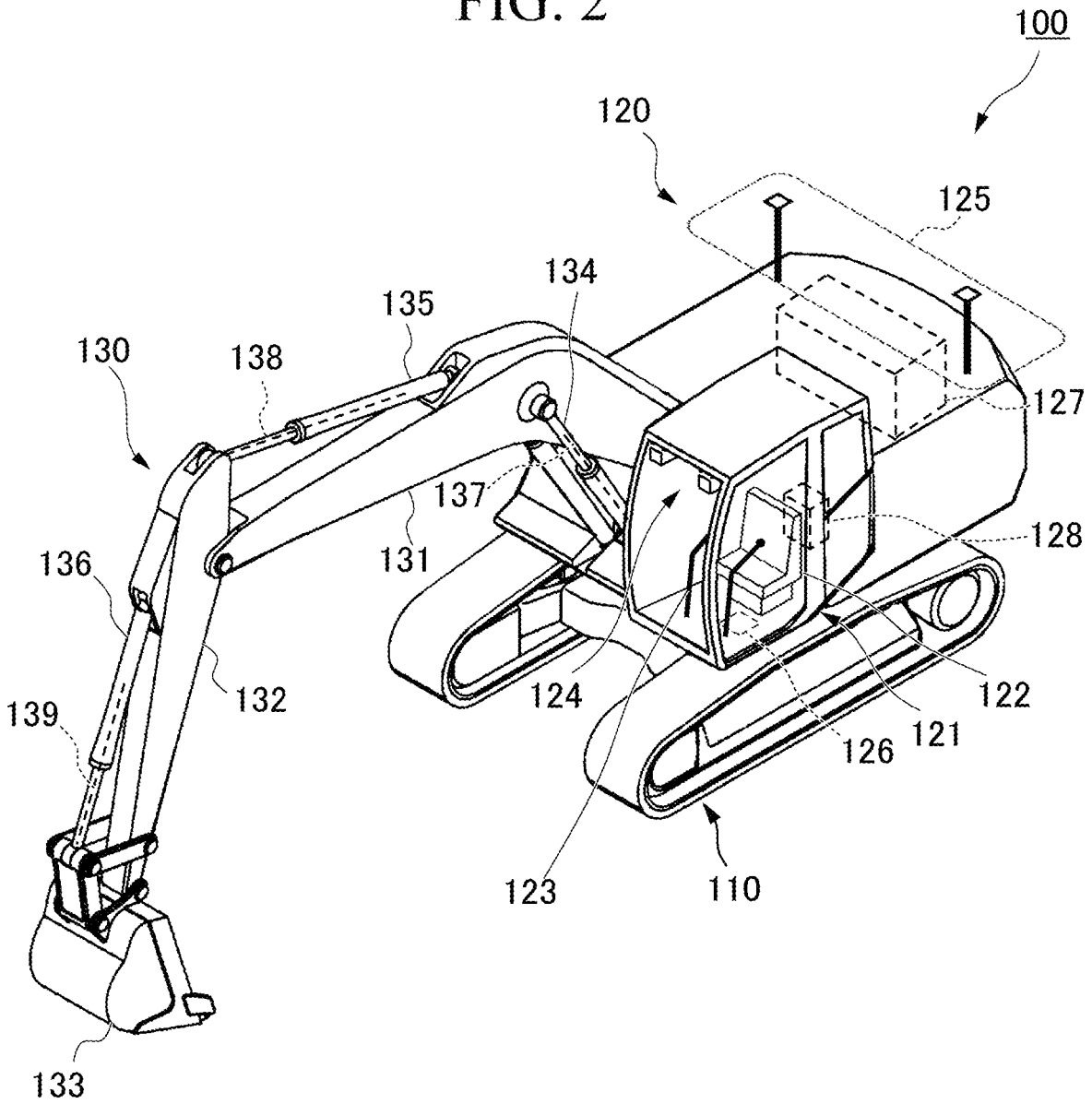
FIG. 2 is a schematic diagram showing a configuration of a loading machine according to the first embodiment.

FIG. 2 is a schematic diagram showing a configuration of the loading machine according to the first embodiment.

The loading machine 100 is a work machine that performs loading of earth to a loading point such as a transport vehicle.

The loading machine 100 includes a travel body 110, a swing body 120 supported by the travel body 110, and work equipment 130 operated by a hydraulic pressure and supported by the swing body 120. The swing body 120 is supported so as to be swingable about a swing center.

The work equipment 130 includes a boom 131, an arm 132, a bucket 133, a boom cylinder 134, an arm cylinder 135, and a bucket cylinder 136.

A base end portion of the boom 131 is attached to the swing body 120 via a pin.

The arm 132 connects the boom 131 and the bucket 133. A base end portion of the arm 132 is attached to a tip end portion of the boom 131 via a pin.

The bucket 133 includes teeth for excavating earth and the like, and a container for transporting excavated earth. A base end portion of the bucket 133 is attached to a tip end portion of the arm 132 via a pin. The bucket 133 according to the first embodiment is attached so that the teeth face rearward of the swing body 120. Therefore, a movement direction of the bucket 133 at the time of excavation in the first embodiment corresponds to a pulling direction of the arm 132.

The boom cylinder 134 is a hydraulic cylinder for operating the boom 131. A base end portion of the boom cylinder 134 is attached to the swing body 120. A tip end portion of the boom cylinder 134 is attached to the boom 131.

The arm cylinder 135 is a hydraulic cylinder for driving the arm 132. A base end portion of the arm cylinder 135 is attached to the boom 131. A tip end portion of the arm cylinder 135 is attached to the arm 132.

The bucket cylinder 136 is a hydraulic cylinder for driving the bucket 133. A base end portion of the bucket cylinder 136 is attached to the arm 132. A tip end portion of the bucket cylinder 136 is attached to a link mechanism that rotates the bucket 133.

A boom stroke sensor 137 measures a stroke amount of the boom cylinder 134. The stroke amount of the boom cylinder 134 is capable of being converted into an inclination angle of the boom 131 with respect to the swing body 120. Hereinafter, the inclination angle with respect to the swing body 120 is also referred to as an absolute angle. That is, the stroke amount of the boom cylinder 134 is capable of being converted into the absolute angle of the boom 131.

The arm stroke sensor 138 measures a stroke amount of the arm cylinder 135. The stroke amount of the arm cylinder 135 is capable of being converted into an inclination angle of the arm 132 with respect to the boom 131. Hereinafter, the inclination angle of the arm 132 with respect to the boom 131 is also referred to as a relative angle of the arm 132.

The bucket stroke sensor 139 measures a stroke amount of the bucket cylinder 136. The stroke amount of the bucket cylinder 136 is capable of being converted into an inclination angle of the bucket 133 with respect to the arm 132. Hereinafter, the inclination angle of the bucket 133 with respect to the arm 132 is also referred to as a relative angle of the bucket 133.

In addition, the loading machine 100 according to another embodiment may include an angle sensor that detects an inclination angle with respect to a ground plane or an inclination angle with respect to the swing body 120 in place of the boom stroke sensor 137, the arm stroke sensor 138, and the bucket stroke sensor 139.

The swing body 120 is provided with a cab 121. An operator's seat 122 for the operator to sit thereon, and an operation device 123 for operating the loading machine 100 are provided inside the cab 121. In response to the operation of the operator, the operation device 123 generates a raising operation signal and a lowering operation signal of the boom 131, a pressing operation signal and a pulling operation signal of the arm 132, a dumping operation signal and an excavating operation signal of the bucket 133, and a swinging operation signal to the left and right sides of the swing body 120, and outputs the signals to the control device 128.

The operation device 123 generates a driving command signal for causing the work equipment 130 to start the automatic drive control in response to the operation of the operator, and outputs the driving command signal to the control device 128. The automatic drive control refers to control to automatically move the work equipment 130 to the excavation point by swinging the swing body 120.

The operation device 123 is constituted by, for example, a lever, a switch, and a pedal. The driving command signal is generated by an operation of the switch for automatic control. For example, when the switch is turned on, the driving command signal is output. The operation device 123 is disposed in the vicinity of the operator's seat 122. The operation device 123 is located within a range operable by the operator when the operator sits on the operator's seat 122.

In addition, the loading machine 100 according to the first embodiment operates in accordance with the operation of the operator sitting on the operator's seat 122; however in other embodiments, the loading machine 100 is not limited to this. For example, the loading machine 100 according to another embodiment may be configured to transmit the operation signals and the driving command signal by a remote operation of the operator operated outside the loading machine 100 to operate the loading machine.

The loading machine 100 includes a depth detection device 124 for detecting a three-dimensional position of a target existing in a detection direction, a position and azimuth direction calculator 125, an inclination measuring device 126, a hydraulic device 127, and a control device 128.

The depth detection device 124 is provided in the cab 121 and detects the depth of a surrounding object including a construction target in a detection range centered on an axis extending forward the swing body 120. The depth is a distance from the depth detection device 124 to the target. Examples of the depth detection device 124 include, for example, a LiDAR device, a radar device, a stereo camera, and the like.

The position and azimuth direction calculator 125 calculates the position of the swing body 120 and the azimuth direction in which the swing body 120 faces. The position and azimuth direction calculator 125 includes two receivers that receive a positioning signal from a satellite configuring a GNSS. The two receivers are provided at positions different from each other on the swing body 120. The position and azimuth direction calculator 125 detects a position of a representative point of the swing body 120 in a site coordinate system (the origin of an excavator coordinate system) based on the positioning signals received by the receivers.

The position and azimuth direction calculator 125 calculates the azimuth direction in which the swing body 120 faces as a relationship between an installation position of one of the receivers and an installation position of the other receiver by using the respective positioning signals received by the two receivers. The azimuth direction in which the swing body 120 faces is a front direction of the swing body 120 and is equal to a horizontal component in an extending direction of a straight line extending from the boom 131 to the bucket 133 of the work equipment 130.

The inclination measuring device 126 measures acceleration and the angular velocity of the swing body 120, and detects a posture (for example, the roll angle and the pitch angle) of the swing body 120 based on the measurement result. The inclination measuring device 126 is installed, for example, on a lower surface of the swing body 120. For example, an inertial measurement unit (IMU) may be used as the inclination measuring device 126.

The hydraulic device 127 includes a hydraulic oil tank, a hydraulic pump, and a flow rate control valve. The hydraulic pump is driven by motive power of an engine (not shown), and supplies hydraulic oil through a flow rate control valve to a travel hydraulic motor (not shown) for causing the travel body 110 to travel, a swing hydraulic motor (not shown) for swinging the swing body 120, the boom cylinder 134, the arm cylinder 135, and the bucket cylinder 136. The flow rate control valve has a rod-shaped spool, and adjusts the flow rate of hydraulic oil supplied to the travel hydraulic motor, the swing hydraulic motor, the boom cylinder 134, the arm cylinder 135, and the bucket cylinder 136 depending on the position of the spool. The spool is driven based on a control command received from the control device 128. That is, the amount of hydraulic oil supplied to the travel hydraulic motor, the swing hydraulic motor, the boom cylinder 134, the arm cylinder 135, and the bucket cylinder 136 is controlled by the control device 128. As described above, the travel hydraulic motor, the swing hydraulic motor, the boom cylinder 134, the arm cylinder 135, and the bucket cylinder 136 are driven by the hydraulic oil supplied from the common hydraulic device 127. In addition, when the travel hydraulic motor or the swing hydraulic motor is a swash plate type variable displacement motor, the control device 128 may adjust the rotation speed by the inclination angle of a swash plate.

The control device 128 receives an operation signal from the operation device 123. The control device 128 drives the work equipment 130, the swing body 120, or the travel body 110 based on the received operation signals.

(Configuration of Control Device)

Figure 3:
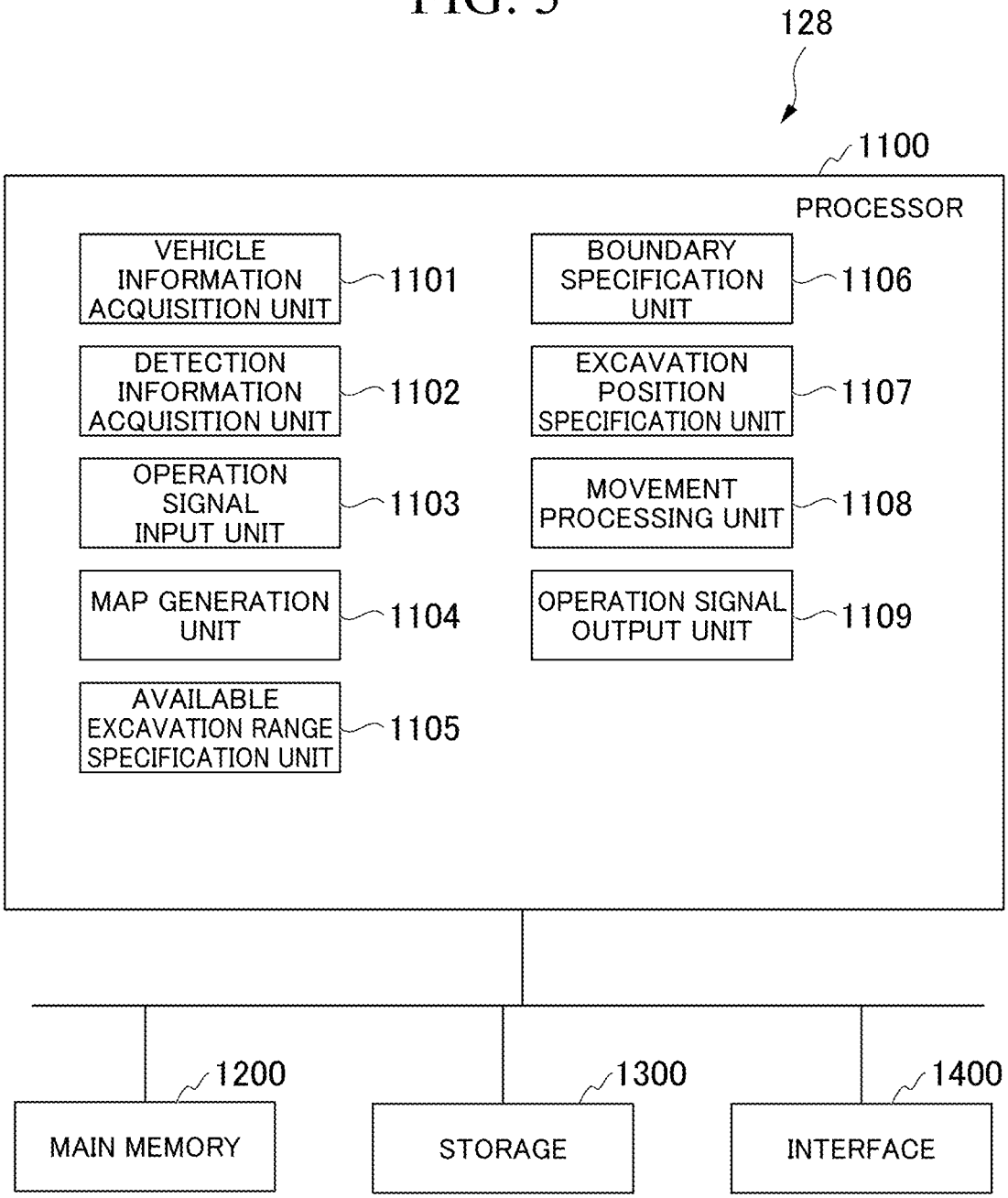
FIG. 3 is a schematic block diagram showing a configuration of a control device according to the first embodiment.

FIG. 3 is a schematic block diagram showing a configuration of the control device according to the first embodiment.

The control device 128 is a computer having a processor 1100, a main memory 1200, a storage 1300, and an interface 1400. The storage 1300 stores a program. The processor 1100 reads the program from the storage 1300, loads the program in the main memory 1200, and executes the processing according to the program.

Examples of the storage 1300 include a HDD, an SSD, a magnetic disk, a magneto-optical disk, a CD-ROM, a DVD-ROM, and the like. The storage 1300 may be an internal medium directly connected to a common communication line of the control device 128, or may be an external medium connected to the control device 128 via the interface 1400. The storage 1300 is a non-transitory tangible storage medium.

The processor 1100 includes a vehicle information acquisition unit 1101, a detection information acquisition unit 1102, an operation signal input unit 1103, a map generation unit 1104 (three-dimensional map acquisition unit), an available excavation range specification unit 1105, a boundary specification unit 1106, an excavation position specification unit 1107, a movement processing unit 1108, and an operation signal output unit 1109 by executing the program.

The vehicle information acquisition unit 1101 acquires, for example, the swing speed, the position, and the azimuth direction of the swing body 120, the inclination angles of the boom 131, the arm 132, and the bucket 133, and the posture of the swing body 120. Hereinafter, information related to the loading machine 100 acquired by the vehicle information acquisition unit 1101 will be referred to as vehicle information.

The detection information acquisition unit 1102 acquires the depth information from the depth detection device 124. The depth information indicates a three-dimensional position of a plurality of points in the detection range. Examples of the depth information include a depth image constituted by a plurality of pixels representing the depth, and point group data constituted by a plurality of points represented by Cartesian coordinates (x, y, z).

The operation signal input unit 1103 receives an input of an operation signal from the operation device 123. The operation signal includes the raising operation signal and the lowering operation signal of the boom 131, the pressing operation signal and the pulling operation signal of the arm 132, the dumping operation signal and the excavation operation signal of the bucket 133, the swinging operation signal of the swing body 120, the traveling operation signal of the travel body 110, and the driving command signal of the loading machine 100.

The map generation unit 1104 generates a three-dimensional map showing a shape around the loading machine 100 in the site coordinate system based on the position, the azimuth direction, and the posture of the swing body 120 acquired by the vehicle information acquisition unit 1101 and the depth information acquired by the detection information acquisition unit 1102. The map generation unit is an example of a three-dimensional map acquisition unit. In another embodiment, the map generation unit 1104 may generate a three-dimensional map related to the excavator coordinate system with respect to the swing body 120.

Figure 4:
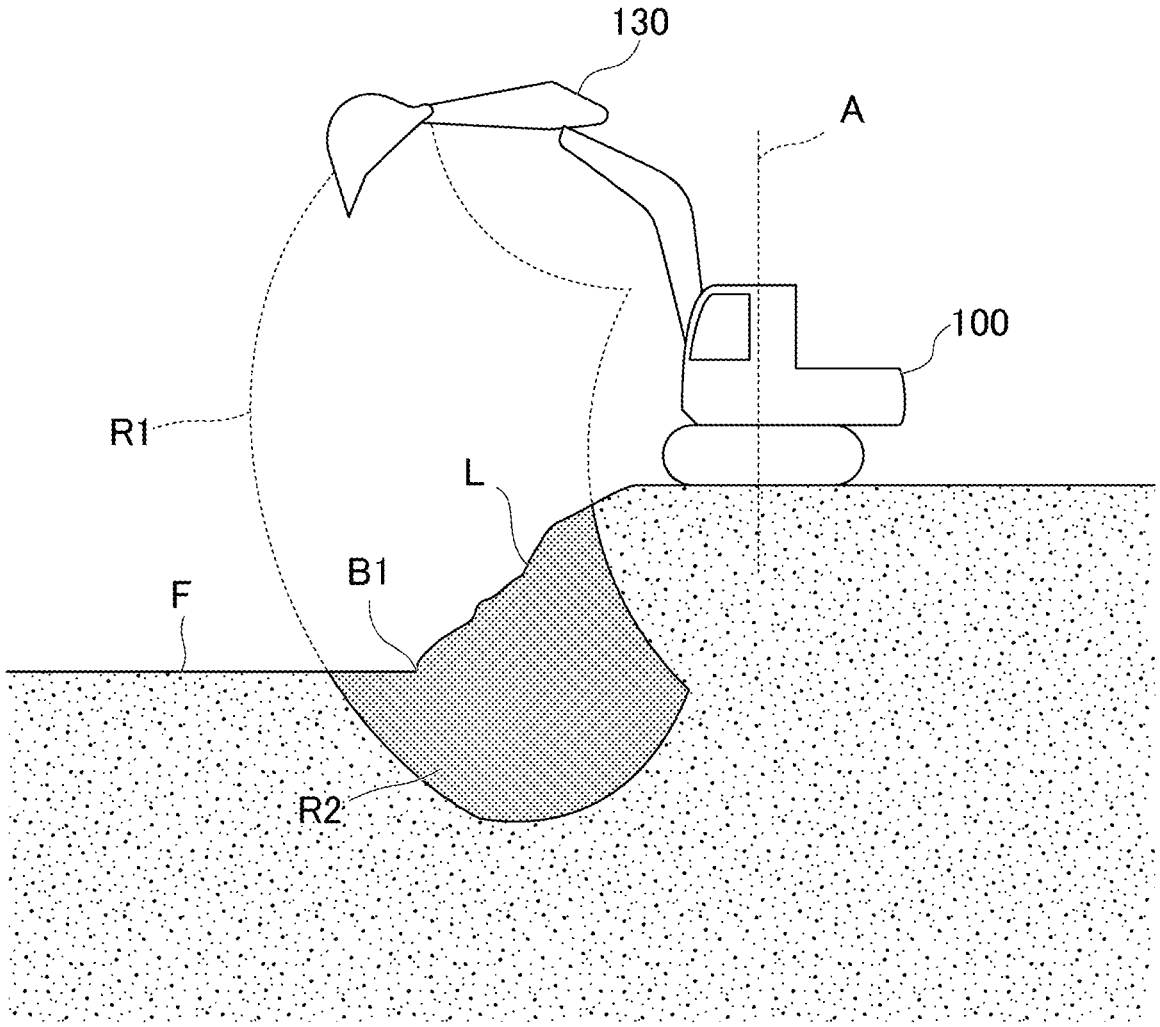
FIG. 4 is a diagram showing an example of a movable range of work equipment.

FIG. 4 is a diagram showing an example of a movable range of the work equipment.

Based on the movable range R1 of the known work equipment 130, the available excavation range specification unit 1105 specifies the available excavation range R2 that is a range in which the loading machine 100 is capable of excavating without traveling in terrain shown by the three-dimensional map. As shown in FIG. 4, the movable range R1 of the work equipment 130 can be shown as a planar figure with reference to the position of the swing body 120 in a plane orthogonal to the pin of the work equipment 130. For this reason, the available excavation range specification unit 1105 can specify, as the available excavation range R2, a range in which a rotation figure rotating the known movable range R1 about a swing central axis A of the swing body 120 and the three-dimensional map overlap each other.

The boundary specification unit 1106 specifies a traveling road boundary line B1 which is a boundary line between the traveling road surface F that is a surface on which the transport vehicle 200 is capable of traveling and the excavation target L by the work equipment 130, in the terrain shown by the three-dimensional map. For example, the boundary specification unit 1106 specifies, as the excavation target L, a portion where an inclination with respect to the horizontal plane exceeds a predetermined angle, and specifies, as the traveling road surface F, a portion that is located below the excavation target L and where an inclination with respect to the horizontal plane is a predetermined angle or less, in the terrain shown by the three-dimensional map. As a result, the boundary specification unit 1106 can specify the traveling road boundary line B1 which is a boundary line between the traveling road surface F and the excavation target L.

Further, as another method, when the transport vehicle 200 includes a positioning device for performing positioning by a GNSS or the like, the boundary specification unit 1106 may specify the traveling road boundary line B1 by the following procedure. The boundary specification unit 1106 acquires, from the positioning device, a height of the transport vehicle 200 when the transport vehicle 200 is in the vicinity of the loading machine 100. The boundary specification unit 1106 specifies, as the traveling road surface F, a portion of the terrain shown by the three-dimensional map where the difference from the height at which the tire of the transport vehicle 200 is in contact with the ground is within a predetermined range. The boundary specification unit 1106 specifies a portion above the specified traveling road surface F as the excavation target L, thereby being capable of specifying the traveling road boundary line B1 between the traveling road surface F and the excavation target L.

In addition, when detecting noise of the depth information acquired by the detection information acquisition unit 1102 and an object having a size that does not interfere with the traveling of the transport vehicle 200 even if the object is earth scattered on the traveling road surface F, the boundary specification unit 1106 may further smooth the specified traveling road boundary line B1 and may set the smoothed specified traveling road boundary line as the traveling road boundary line B1. More specifically, an unevenness of the traveling road boundary line B1 that is sufficiently smaller than a width of the bucket 133 is smoothed by smoothing the unevenness.

Figure 5:
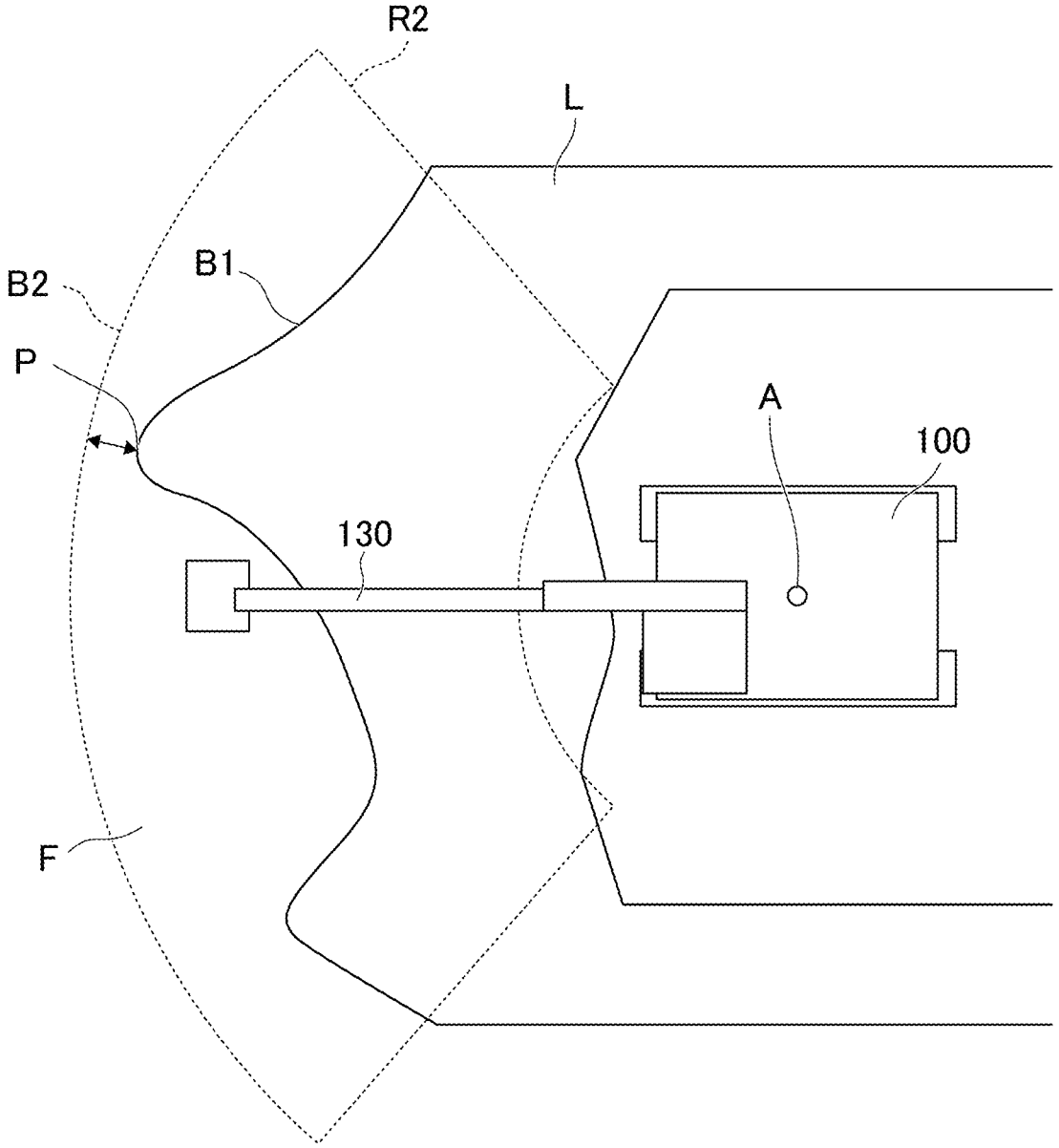
FIG. 5 is a top view showing a positional relationship between a work machine and an excavation target.

FIG. 5 is a top view showing a positional relationship between the work machine and the excavation target.

The excavation position specification unit 1107 specifies an excavation start point P by the work equipment 130 based on the available excavation range R2 specified by the available excavation range specification unit 1105 and the traveling road boundary line B1 specified by the boundary specification unit 1106. Specifically, the excavation position specification unit 1107 determines, as the excavation start point P, a point that is on the traveling road boundary line B1 in the available excavation range R2 and at which a distance from the swing central axis A to said point on the traveling road boundary line is the longest. The excavation start point P is also a point on the traveling boundary line B1 and at which a distance is the shortest between the traveling road boundary line B1 and the rear boundary line B2 that is a boundary line of the available excavation range R2 on a pushing direction side of the arm 132, that is, on the rear side in the movement direction of the bucket 133 during excavation.

Further, the excavation position specification unit 1107 may offset the determined excavation start point P upward by a predetermined height. That is, the excavation start point P is not limited to a point on the traveling road boundary line B1, and may be a point above the traveling road boundary line B1. This is because the portion lower than the traveling road boundary line B1 is not the excavation target, has hard ground, and it is difficult to excavate when excavation is started with the height on the traveling road boundary line B1 being the excavation start point: therefore, excavation is facilitated by setting the excavation start point at a height offset upward by a predetermined height from the traveling road boundary line B1.

When the operation signal input unit 1103 receives an input of the driving command signal, the movement processing unit 1108 generates an operation signal of the swing body 120 and the work equipment 130 for moving the bucket 133 to the excavation start point P.

The operation signal output unit 1109 outputs an operation signal input to the operation signal input unit 1103 or an operation signal generated by the movement processing unit 1108. Specifically, the operation signal output unit 1109 outputs the operation signal generated by the movement processing unit 1108 when the automatic drive control is being performed, and outputs the operation signal input to the operation signal input unit 1103 when the automatic drive control is not being performed.

(Automatic Drive Control)

When the operator of the loading machine 100 determines that the loading machine 100 and the excavation target L are in a positional relationship in which the excavation processing can be performed, the operator turns on the switch of the operation device 123. Accordingly, the operation device 123 generates and outputs the driving command signal.

Figure 6:
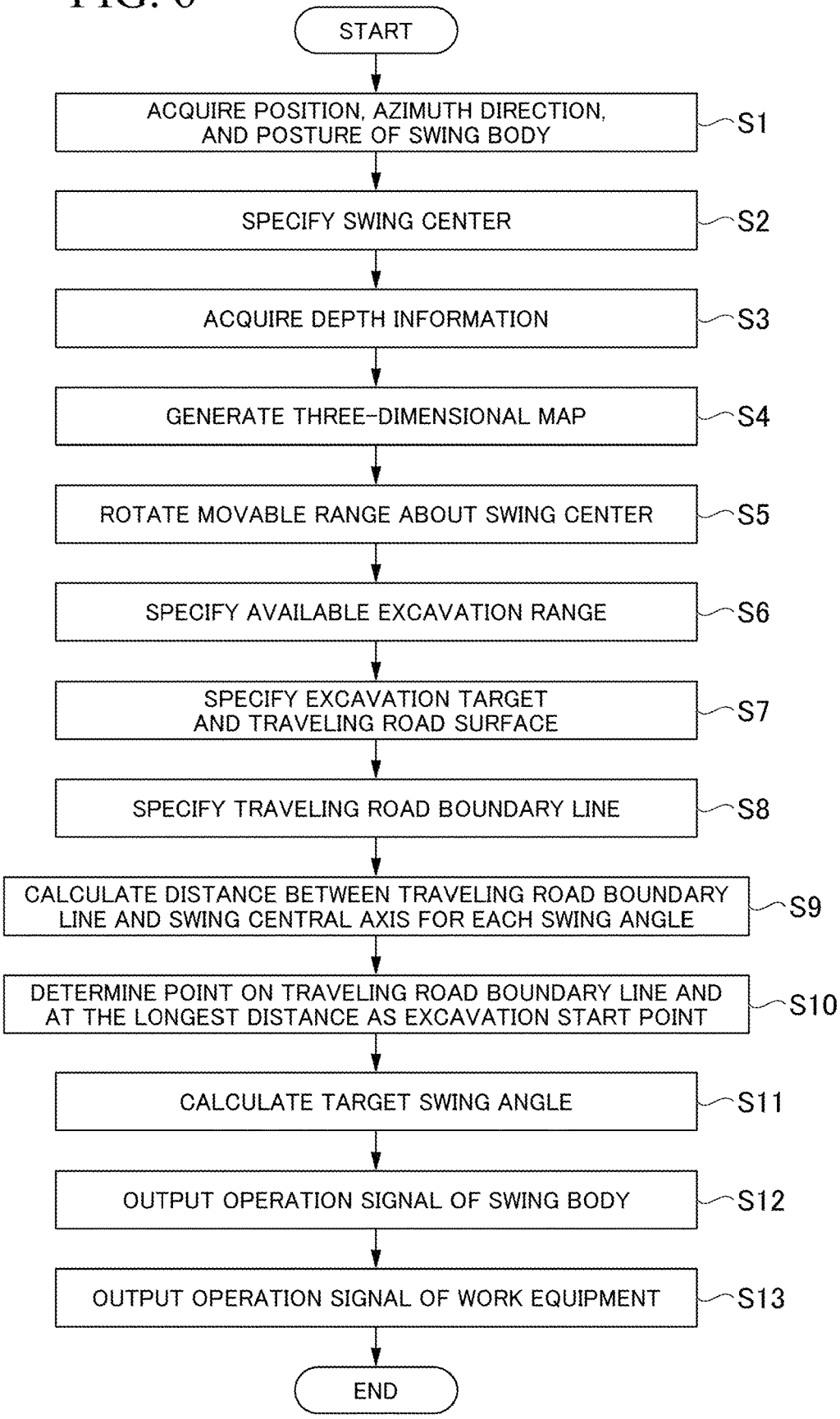
FIG. 6 is a flowchart showing automatic excavation control according to the first embodiment.

FIG. 6 is a flowchart showing the automatic drive control according to the first embodiment. When receiving an input of the driving command signal from the operator, the control device 128 executes the automatic drive control shown in FIG. 6.

The vehicle information acquisition unit 1101 acquires the position, the azimuth direction, and the posture of the swing body 120 (step S1). The vehicle information acquisition unit 1101 specifies the position of the swing central axis A of the swing body 120 on the basis of the acquired position and azimuth direction of the swing body 120 (step S2).

The detection information acquisition unit 1102 acquires the depth information indicating a depth in front of the loading machine 100 from the depth detection device 124 (step S3). The map generation unit 1104 generates the three-dimensional map showing a shape in front of the loading machine 100 by the site coordinate system based on the position, the azimuth direction, and the posture of the swing body 120 acquired by the vehicle information acquisition unit 1101 and the depth information acquired by the detection information acquisition unit 1102 (step S4).

The available excavation range specification unit 1105 generates the rotation figure in which the known movable range R1 is rotated about the swing central axis A specified in step S2 (step S5). The available excavation range specification unit 1105 specifies a range in which the three-dimensional map and the rotation figure overlap each other as the available excavation range R2 (step S6).

The boundary specification unit 1106 specifies, as the excavation target L, a portion where an inclination with respect to the horizontal plane exceeds a predetermined angle in terrain shown by the three-dimensional map and specifies, as the traveling road surface F, a portion that is located below the excavation target L and where the inclination with respect to the horizontal plane is equal to or less than the predetermined angle (step S7). The boundary specification unit 1106 specifies the traveling road boundary line B1 which is a boundary line between the specified traveling road surface F and the excavation target L (step S8).

The excavation position specification unit 1107 calculates a distance between the traveling road boundary line B1 and the swing central axis A for each azimuth direction with respect to the swing central axis A of the swing body 120 in the detection range (step S9). At this time, the excavation position specification unit 1107 may limit the range of the azimuth direction that is a calculation target of the distance to a range within a predetermined angle (for example, 90 degrees) from a stop position of the transport vehicle 200. The excavation position specification unit 1107 determines a point on the traveling road boundary line B1 and at which the calculated distance is the longest as the excavation start point P (step S10).

The movement processing unit 1108 calculates a target swing angle of the swing body 120 on the basis of an angle formed by a direction in which the swing body 120 faces and a direction from the swing central axis A toward the excavation start point P (step S11). The movement processing unit 1108 generates a swing operation signal based on the target swing angle, and the operation signal output unit 1109 outputs the swing operation signal to the hydraulic device 127 (step S12).

Then, the movement processing unit 1108 generates an operation signal of the work equipment 130 for moving teeth of the bucket 133 to the excavation start point P, and the operation signal output unit 1109 outputs the work equipment operation signal to the hydraulic device 127 (step S13). In addition, the swing operation in step S12 and the work equipment operation in step S13 may be performed simultaneously, or the work equipment operation in step S13 may be performed after the swing operation in step S12.

By the above-described automatic drive control, the loading machine 100 can automatically move the teeth of the bucket 133 to the excavation start point. The operator can then perform the excavation operation by the operation device 123. In another embodiment, the control device 128 may perform automatic excavation control according to a predetermined trajectory, or the control device 128 may further perform automatic loading control after the automatic excavation control.

(Operation and Effects)

As described above, the control device 128 of the loading machine 100 according to the first embodiment specifies the available excavation range R2 and the traveling road boundary line B1 based on the terrain shown by the three-dimensional map indicating the shape around the loading machine 100, and determines the point on the traveling road boundary line B1 as the excavation start point P by the work equipment 130. As a result, the loading machine 100 can excavate the excavation target L from a lower side of an inclined surface. By excavating the excavation target L from the lower side of the inclined surface, even when part of the inclined surface collapses, a distance in which the collapsed earth flows on the traveling road surface F becomes short. As a result, it is possible to suppress a flow velocity of earth and to prevent scattering of earth on the traveling road surface F.

Further, the control device 128 according to the first embodiment determines, as the excavation start point P, a point that is on the traveling road boundary line B1 and at which a distance from the swing central axis A to said point on the traveling road boundary line is the longest. That is, the control device 128 determines, as the excavation start point P, a point that is on the traveling road boundary line B1 and at which a distance from said point on the traveling road boundary line to the rear boundary line B2 is the shortest. As a result, the control device 128 can quickly widen a range in which the transport vehicle 200 is capable of traveling. Further, as a distance between the traveling road boundary line B1 and an upper end of the inclined surface is shorter, there is a higher possibility that the inclined surface is steep. For this reason, by setting the point at which a distance to the front boundary line B2 is the longest as the excavation start point P, it is possible to reduce the possibility of the collapse of the inclined surface. In addition, the control device 128 according to another embodiment may determine the excavation start point P based on the other conditions. For example, the control device 128 according to another embodiment may determine, as the excavation start point P, a point at which the swing angle is the smallest at the point on the traveling road boundary line B1.

SECOND EMBODIMENT

The loading machine 100 according to the first embodiment is located at the upper stage of the excavation target, and excavates earth from a lower side of the inclined surface. At this time, there is a possibility that the excavation target L on the lower side of the inclined surface is hidden by the excavation target L on an upper side of the inclined surface and thus the three-dimensional position of the excavation target cannot be specified. The control device 128 according to a second embodiment estimates a shape of the excavation target L in the hidden portion, and determines the excavation start point P based on the estimated shape.

Figure 7:
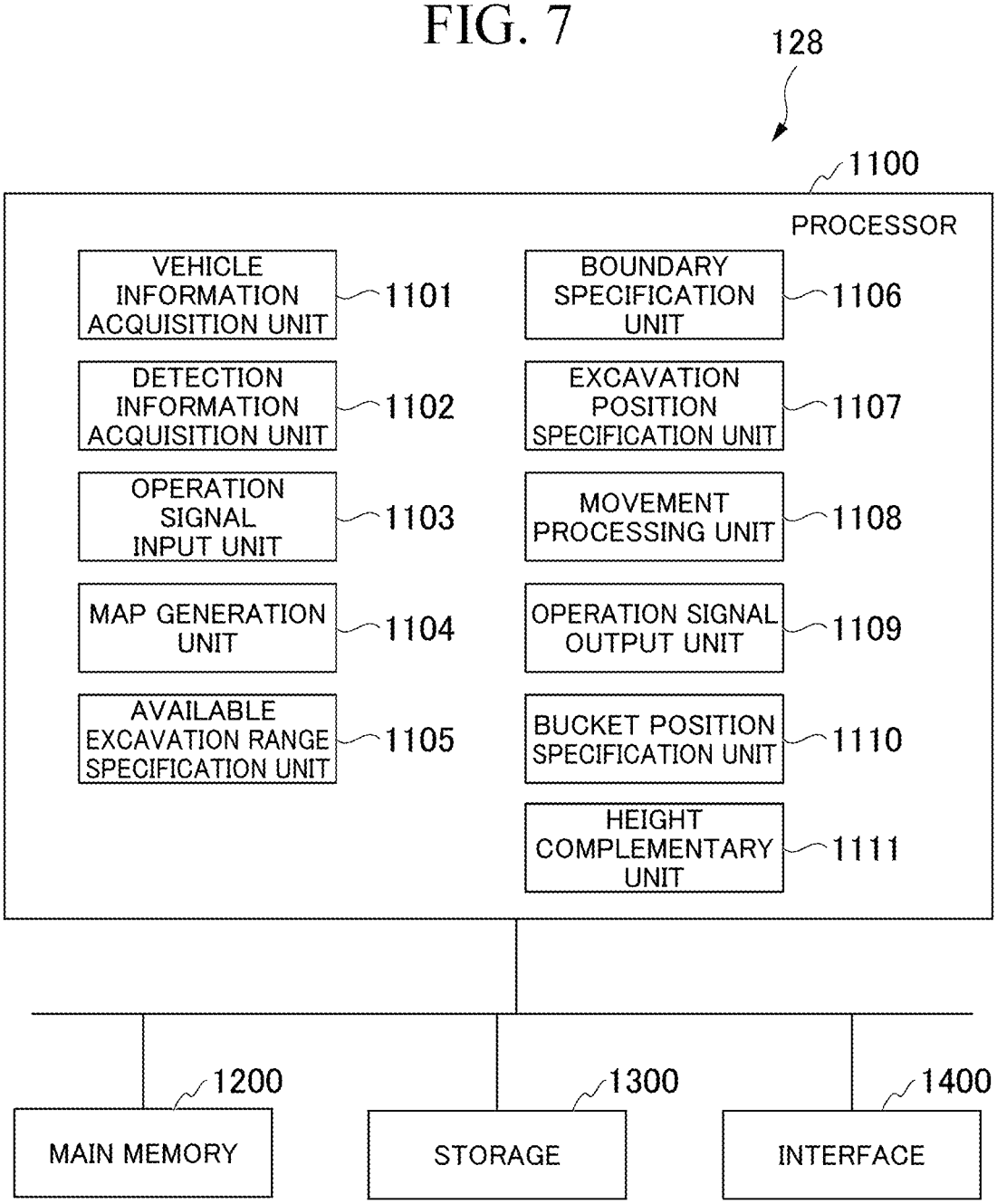
FIG. 7 is a schematic block diagram showing a configuration of a control device according to a second embodiment.

FIG. 7 is a schematic block diagram showing a configuration of a control device according to the second embodiment.

The control device 128 according to the second embodiment further includes a bucket position specification unit 1110 and a height complementary unit 1111 in addition to the configuration of the first embodiment.

The bucket position specification unit 1110 specifies the position of the teeth of the bucket 133 in the excavator coordinate system based on the vehicle information acquired by the vehicle information acquisition unit 1101. Specifically, the bucket position specification unit 1110 specifies the position of the teeth of the bucket 133 in line with the following procedure. The bucket position specification unit 1110 obtains a position of the tip end portion of the boom 131 based on the absolute angle of the boom 131 obtained from the stroke amount of the boom cylinder 134 and the known length of the boom 131 (a distance from the pin at the base end portion to the pin at the tip end portion). The bucket position specification unit 1110 obtains an absolute angle of the arm 132 based on the absolute angle of the boom 131 and the relative angle of the arm 132 obtained from the stroke amount of the arm cylinder 135. The bucket position specification unit 1110 obtains a position of the tip end portion of the arm 132 based on the position of the tip end portion of the boom 131, the absolute angle of the arm 132, and the known length of the arm 132 (a distance from the pin at the base end portion to the pin at the tip end portion). Then, the bucket position specification unit 1110 obtains the position of the teeth of the bucket 133 based on the position of the tip end portion of the arm 132, an absolute angle of the bucket 133, and the known length of the bucket 133 (a distance from the pin at the base end portion to the teeth).

Figure 8:
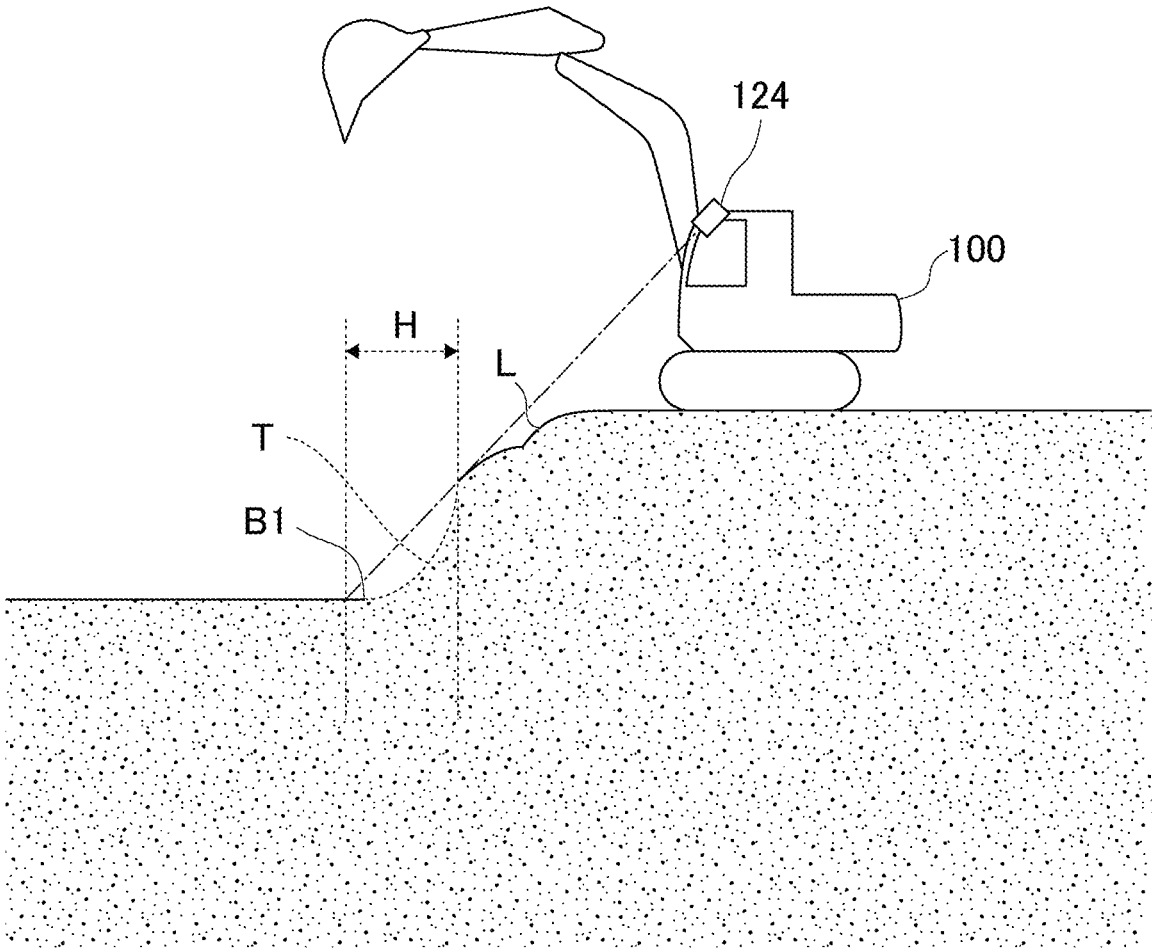
FIG. 8 is a diagram showing an example of a complementing method of a shape of a three-dimensional map according to the second embodiment.

FIG. 8 is a diagram showing an example of a complementing method of a shape of the three-dimensional map according to the second embodiment.

The height complementary unit 1111 complements a shape of a hidden portion H hidden by the excavation target L in the three-dimensional map based on a history of the position of the teeth of the bucket 133. Specifically, the height complementary unit 1111 estimates a three-dimensional shape of a portion excavated by the bucket 133 based on a trajectory T of the teeth of the bucket 133 specified by the bucket position specification unit 1110. The height complementary unit 1111 specifies a portion where a value of the height in plan view from above in the three-dimensional map is missing as the hidden portion H, and complements a height of the hidden portion H by a height related to the three-dimensional shape estimated from the trajectory T.

As described above, according to the second embodiment, the control device 128 complements the height of the hidden portion H of the three-dimensional map based on the history of the position of the teeth of the bucket 133, and specifies the traveling road boundary line B1 based on the complemented three-dimensional map. Accordingly, the control device 128 according to the second embodiment can appropriately specify the excavation start point P even when the excavation target L at the lower side of the inclined surface is hidden by the excavation target L at the upper side of the inclined surface.

THIRD EMBODIMENT

The inclined surface of the excavation target L is more likely to collapse as the inclined surface is steeper. The loading machine 100 according to a third embodiment specifies an appropriate excavation start point P while preventing a staging ground of the loading machine 100 from collapsing.

Figure 9:
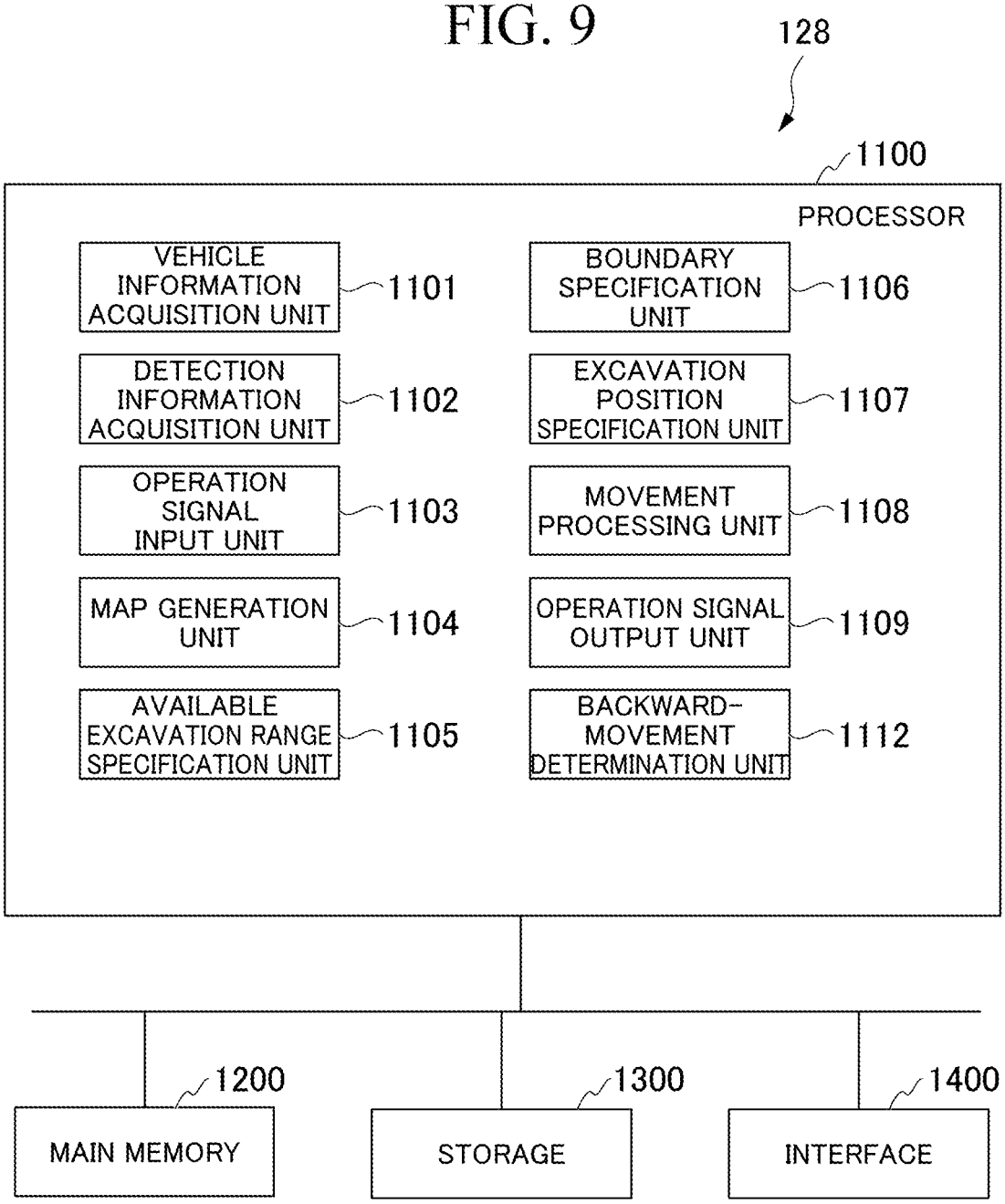
FIG. 9 is a schematic block diagram showing a configuration of a control device according to a third embodiment.

FIG. 9 is a schematic block diagram showing a configuration of a control device according to the third embodiment.

The control device 128 according to the third embodiment further includes a backward-movement determination unit 1112 in addition to the configuration of the first embodiment.

Figure 10:
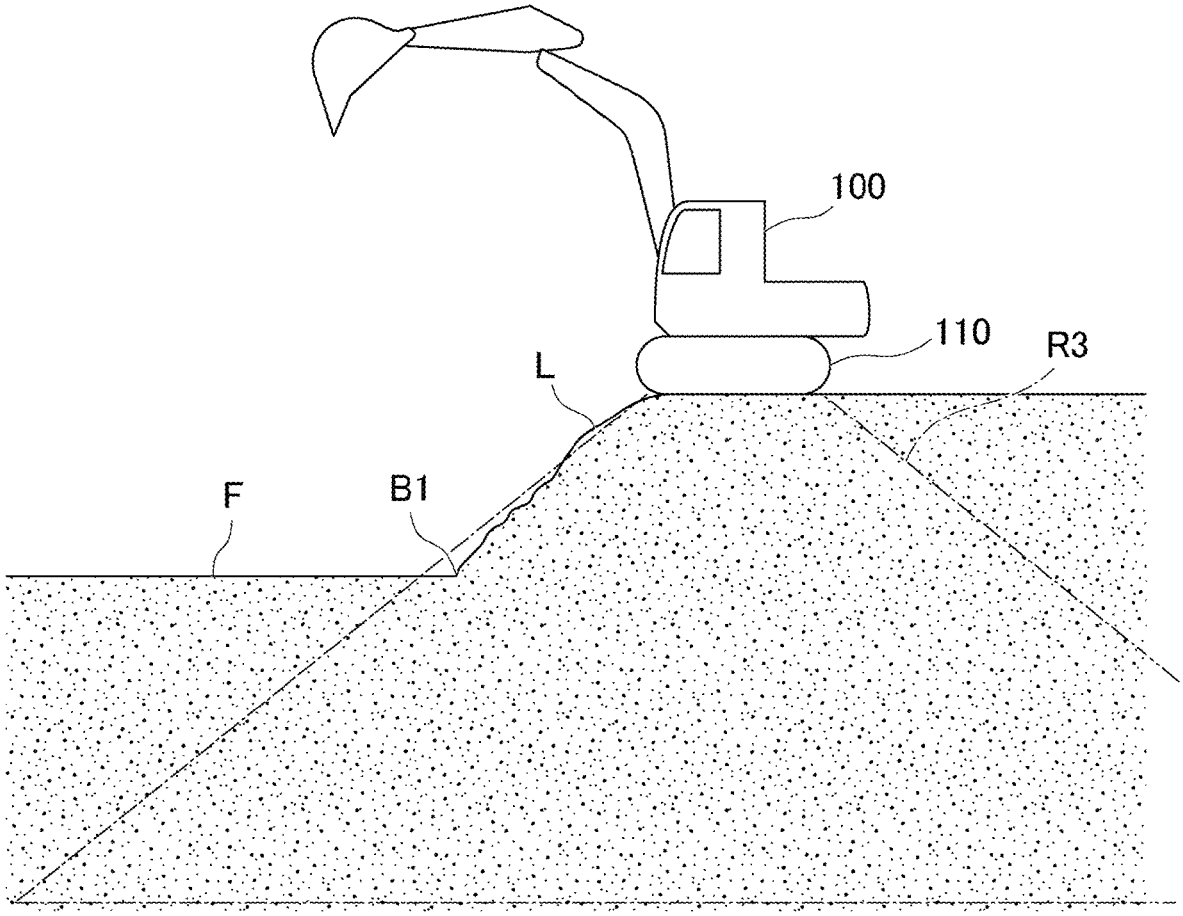
FIG. 10 is a diagram showing an example of a prohibited excavation area according to the third embodiment.

FIG. 10 is a diagram showing an example of a prohibited excavation area according to the third embodiment.

When the excavation start point P specified by the excavation position specification unit 1107 is within a prohibited excavation area R3 that spreads obliquely downward from a position of the travel body 110, the backward-movement determination unit 1112 determines to move the travel body 110 backward. That is, the backward-movement determination unit 1112 does not adopt the excavation start point P when the excavation start point P is within the prohibited excavation area R3. Accordingly, the control device 128 prevents an inclination of the inclined surface of the excavation target L from becoming steep. The inclination of the prohibited excavation area R3 is determined based on the angle of repose of the excavation target L, for example.

(Automatic Drive Control)

Figure 11:
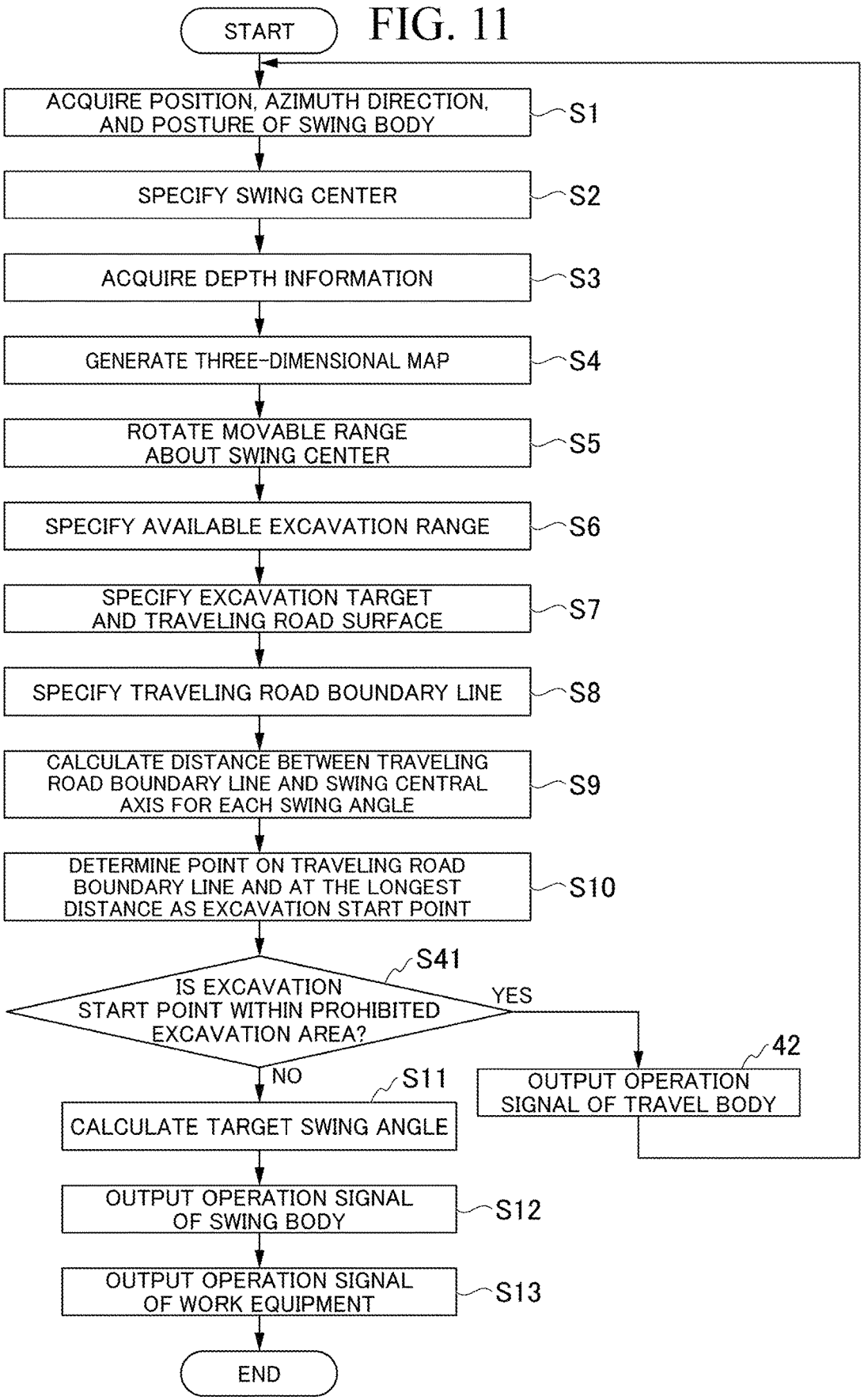
FIG. 11 is a flowchart showing automatic excavation control according to the third embodiment.

FIG. 11 is a flowchart showing an automatic drive control according to the third embodiment. When receiving the input of the driving command signal from the operator, the control device 128 executes the automatic drive control shown in FIG. 11.

The control device 128 obtains the excavation start point P in the same manner as in Step S1 to Step S10 of the first embodiment. Next, the backward-movement determination unit 1112 determines whether or not the excavation start point P is within the prohibited excavation area R3 that spreads obliquely downward from the position of the travel body 110 (step S41). When the excavation start point P is not within the prohibited excavation area R3 (step S41: NO), the control device 128 performs the automatic drive control in the same manner as in steps S11 to S13 of the first embodiment. On the other hand, when the excavation start point P is within the prohibited excavation area R3 (step S41: YES), the movement processing unit 1108 generates a traveling operation signal for moving the travel body 110 backward, and the operation signal output unit 1109 outputs the traveling operation signal to the hydraulic device 127 (step S42). Then, the control device 128 returns the processing to step S1, and determines the excavation start point again.

(Operation and Effects)

As described above, the control device 128 of the loading machine 100 according to the third embodiment moves the travel body 110 backward when the excavation start point P is within the prohibited excavation area R3 that spreads obliquely downward from the position of the travel body 110. That is, the control device 128 determines, as the excavation start point P, a point that is on the traveling road boundary line B1 and outside the prohibited excavation area R3. Accordingly, it is possible to prevent the staging ground of the loading machine 100 from collapsing due to the collapse of the inclined surface caused by the excavation of the excavation target L. In addition, the control device 128 according to the third embodiment moves the travel body 110 backward when the excavation start point P is within the prohibited excavation area R3; however, the present invention is not limited thereto. For example, the control device 128 according to another embodiment may output an alarm indicating that the excavation cannot be performed at the current position of the loading machine 100 when the excavation start point P is within the prohibited excavation area R3.

FOURTH EMBODIMENT

The first to third embodiments are embodiments related to excavation by the backhoe shovel. In a fourth embodiment, excavation by the face shovel will be described.

Figure 12:
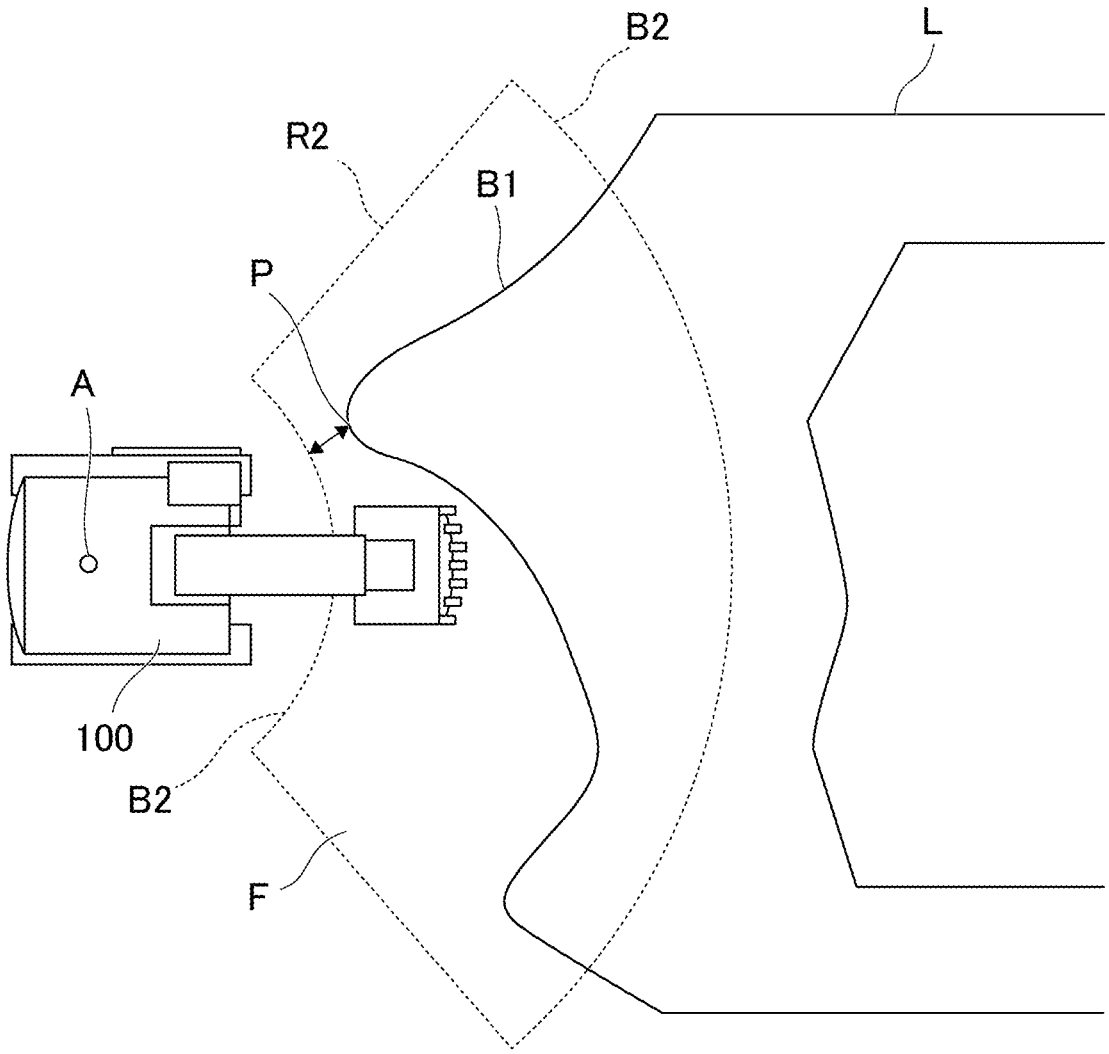
FIG. 12 is a diagram showing an example of excavation and loading work according to a fourth embodiment.

FIG. 12 is a diagram showing an example of excavation and loading work according to the fourth embodiment. The loading machine 100 is disposed on the traveling road surface F, excavates the excavation target L in front, and loads the earth that has been excavated on the transport vehicle 200.

The bucket 133 according to the fourth embodiment is attached such that the teeth face the front of the swing body 120. Therefore, the movement direction of the bucket 133 at the time of excavation in the fourth embodiment is the pressing direction of the arm 132.

The excavation position specification unit 1107 according to the fourth embodiment determines, as the excavation start point P, a point that is on the traveling road boundary line B1 in the available excavation range R2 and at which a distance from the swing central axis A to said point is the shortest. The excavation start point P is also a point at which the distance between the rear boundary line B2 and the traveling road boundary line B1 is the shortest, the rear boundary line B2 being a boundary line of the available excavation range R2 on the pulling direction side of the arm 132, that is, on the rear side in the movement direction of the bucket 133 during excavation.

As described above, the control device 128 according to the fourth embodiment also determines, as the excavation start point P, a point at which the distance between the rear boundary line B2, which is a boundary line of the available excavation range R2 on the side opposite to the movement direction of the bucket 133 at the time of excavation, and the traveling road boundary line B1 is the shortest. As a result, as in the first embodiment, the range that the transport vehicle 200 is capable of traveling can be widened early, and scattering of earth to the traveling road surface F due to the collapse of the inclined surface can be suppressed.

Other Embodiment

As described in the above, an embodiment has been described in detail with reference to the drawings; however, a specific configuration is not limited to the description above, and various design changes and the like can be made.

In addition, the loading machine 100 according to the above-described embodiment is a manned driving vehicle which an operator gets on and operates, but the loading machine 100 is not limited to this. For example, the loading machine 100 according to another embodiment may be a remote driving vehicle that is operated by an operation signal acquired through communication from a remote operation device in which an operator in a remote office operates while looking at a screen of a monitor. In this case, some of the functions of the control device 128 may be provided in the remote operation device.

The control device according to the present invention is capable of planning excavation so as to prevent earth from being scattered on a traveling surface.

The invention claimed is:

1. A control device for a work machine including a travel body, a swing body supported by the travel body and being capable of swinging about a swing central axis, and work equipment provided to the swing body and having a bucket, the control device comprising:

a memory in which a program is loaded; and a processor configured to execute the program, the processor including, by executing the program, a three-dimensional map acquisition unit configured to acquire a three-dimensional map indicating a shape around the work machine:

an available excavation range specification unit configured to specify an available excavation range in which a rotation figure obtained by rotating a movable range of the work equipment about the swing central axis of the swing body and the three-dimensional map overlap each other when viewed in a direction along the swing central axis, the available excavation range being a range in which the work machine is capable of excavating without traveling:

a boundary specification unit configured to specify a traveling road boundary line in terrain shown by the three-dimensional map, the traveling road boundary line being a boundary line between a traveling road surface on which a transport vehicle different from the work machine is capable of traveling, and an excavation target by the work equipment, the excavation target being excluded from the traveling road surface by the traveling road boundary line; and an excavation position specification unit configured to determine an excavation start point by the work equipment from among a plurality of points on or above the traveling road boundary line for each azimuth direction with respect to the swing central axis in the available excavation range, based on a distance between the swing central axis and the traveling road boundary line.

2. The control device according to claim 1, wherein the excavation position specification unit is configured to determine, as the excavation start point, a point that is on the traveling road boundary line and at which a distance between the point and a rear boundary line is the shortest, the rear boundary line being a boundary line of the available excavation range on a rear side in a movement direction of the bucket at the time of excavation.

3. The control device according to claim 1, wherein the excavation position specification unit is configured to determine, as the excavation start point, a point on the traveling road boundary line and outside a prohibited excavation area that spreads obliquely downward from a position of the work machine.

4. The control device according to claim 1, wherein the processor further includes, by executing the program, an operation signal output unit configured to output an operation signal usable to operate the swing body and the work equipment based on the excavation start point.

5. A control device for a work machine including a travel body, a swing body supported by the travel body and being capable of swinging about a swing central axis, and work equipment provided to the swing body and having a bucket, the control device comprising:

a memory in which a program is loaded; and a processor configured to execute the program, the processor including, by executing the program, a three-dimensional map acquisition unit configured to acquire a three-dimensional map indicating a shape around the work machine:

an available excavation range specification unit configured to specify a range in which the work machine is capable of excavating without traveling as an available excavation range in terrain shown by the three-dimensional map:

a boundary specification unit configured to specify a traveling road boundary line in terrain shown by the three-dimensional map, the traveling road boundary line being a boundary line between a traveling road surface on which a transport vehicle is capable of traveling, and an excavation target by the work equipment:

an excavation position specification unit configured to determine an excavation start point by the work equipment from among a plurality of points on or above the traveling road boundary line for each azimuth direction with respect to the swing central axis in the available excavation range, based on a distance between the swing central axis and the traveling road boundary line:

a bucket position specification unit configured to specify a position of teeth of the bucket; and a height complementary unit configured to complement a height of a hidden portion hidden by the excavation target in the three-dimensional map based on a history of a position of teeth of the bucket, the boundary specification unit being configured to specify the traveling road boundary line based on a three-dimensional map in which the height of the hidden portion is complemented.

6. The control device according to claim 1, wherein the excavation position specification unit is configured to determine a point at which a point on the traveling road boundary line is offset upward by a predetermined height, as an excavation start point.

7. A control method for a work machine including a travel body, a swing body supported by the travel body and being capable of swinging about a swing central axis, and work equipment provided to the swing body and having a bucket, the control method comprising:

acquiring a three-dimensional map showing a shape around the work machine;

specifying an available excavation range in which a rotation figure obtained by rotating a movable range of the work equipment about the swing central axis of the swing body and the three-dimensional map overlap each other when viewed in a direction along the swing central axis, the available excavation range being a range in which the work machine is capable of excavating without traveling:

specifying a traveling road boundary line in terrain shown by the three-dimensional map, the traveling road boundary line being a boundary line between a traveling road surface that is a surface on which a transport vehicle different from the work machine is capable of traveling, and an excavation target by the work equipment, the excavation target being excluded from the traveling road surface by the traveling road boundary line; and determining an excavation start point by the work equipment from among a plurality of points on or above the traveling road boundary line for each azimuth direction with respect to the swing central axis in the available excavation range, based on a distance between the swing central axis and the traveling road boundary line.

8. The control device according to claim 1, wherein the excavation position specification unit is configured to determine a point on or above the traveling road boundary line as the excavation start point, based on the available excavation range specified by the available excavation range specification unit and the traveling road boundary line specified by the boundary specification unit.

9. The control device according to claim 1, wherein the excavation position specification unit determines, as the excavation start point, a point on the traveling road boundary line at which a distance between the traveling road boundary line and the swing central axis is longest or one of a plurality of points on the traveling road boundary line at which the distance is longest.

* * * * *